US009879452B2

(12) United States Patent
Bendel et al.

(10) Patent No.: US 9,879,452 B2
(45) Date of Patent: Jan. 30, 2018

(54) METHOD FOR PRODUCING MOTOR VEHICLE DOOR LOCKS WITH PAWL PLACED IN AN OBLIQUE MANNER

(71) Applicant: Kiekert Aktiengesellschaft, Heiligenhaus (DE)

(72) Inventors: Thorsten Bendel, Oberhausen (DE); Werner Pohle, Dortmund (DE); Thomas Waldmann, Mulheim Ruhr (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 220 days.

(21) Appl. No.: 14/649,944

(22) PCT Filed: Dec. 11, 2013

(86) PCT No.: PCT/DE2013/000773
§ 371 (c)(1),
(2) Date: Jul. 13, 2015

(87) PCT Pub. No.: WO2014/090218
PCT Pub. Date: Jun. 19, 2014

(65) Prior Publication Data

US 2015/0315828 A1 Nov. 5, 2015

(30) Foreign Application Priority Data

Dec. 12, 2012 (DE) ..... 10 2012 024 285

(51) Int. Cl.
*E05C 3/06* (2006.01)
*E05B 85/24* (2014.01)
(Continued)

(52) U.S. Cl.
CPC ..... *E05B 85/243* (2013.01); *B21D 51/46* (2013.01); *B21D 51/48* (2013.01); *E05B 77/40* (2013.01);
(Continued)

(58) Field of Classification Search
CPC ..... Y10T 292/1075; Y10T 292/1047; Y10T 292/1082; E05B 77/40; E05B 79/10; E05B 85/243
(Continued)

(56) References Cited

U.S. PATENT DOCUMENTS 1,789,775 A * 1/1931 Russ ..... E05C 3/24 292/198
2,873,602 A * 2/1959 France ..... E05B 83/16 292/216
(Continued)

FOREIGN PATENT DOCUMENTS

DE 102007060626 A1 6/2009
DE 102010009141 A1 8/2011
EP 1500762 A2 1/2005

OTHER PUBLICATIONS

Machine translation of DE102007060626A1 by Lexis Nexis Total Patent on Jul. 9, 2015.
(Continued)

*Primary Examiner* — Carlos Lugo
(74) *Attorney, Agent, or Firm* — Woodard, Emhardt, Moriarty, McNett & Henry LLP

(57) ABSTRACT

In order to minimize the sliding friction between the locking parts, that is, between the pawl and the rotary latch of a motor vehicle door lock, it is advantageous if, during the production process, the different latch surfaces of both locking parts are provided with a stamped contour have straight grooves and also with a stamped contour, charac-
(Continued)

terized in that the provided grooves are oblique. The grooves which are oblique to the latch surface on the pawl can be produced such that the entire pawl or also the rotary latch are connected in an oblique manner to the base of the lock case housing which can be produced in several ways. Between the straight grooves and the oblique grooves, at least two coverings are provided which ensure that both locking parts are in mutual contact reducing the friction.

20 Claims, 3 Drawing Sheets

(51) Int. Cl.

| | |
|---|---|
| ***E05B 79/10*** | (2014.01) |
| ***E05B 77/40*** | (2014.01) |
| ***E05B 85/26*** | (2014.01) |
| ***B21D 51/46*** | (2006.01) |
| ***B21D 51/48*** | (2006.01) |
| *E05C 3/16* | (2006.01) |

(52) U.S. Cl.
CPC ..... *E05B 79/10* (2013.01); *E05B 85/26* (2013.01); *Y10T 29/49886* (2015.01); *Y10T 292/1047* (2015.04); *Y10T 292/1075* (2015.04); *Y10T 292/1082* (2015.04)

(58) Field of Classification Search
USPC ..... 292/194, 195, 216
See application file for complete search history.

(56) References Cited

U.S. PATENT DOCUMENTS 2,977,785 A * 4/1961 Beckman ..... E05B 83/16 292/129
2,996,327 A * 8/1961 France ..... E05B 83/16 292/216
3,262,725 A * 7/1966 Ballantyne ..... B60N 2/366 292/216
3,408,100 A * 10/1968 McKey ..... E05B 83/16 292/216
3,622,188 A * 11/1971 Goeman ..... E05B 85/243 292/216
4,358,141 A * 11/1982 Hamada ..... E05B 85/243 292/216
5,642,636 A * 7/1997 Mitsui ..... E05B 17/0062 292/201
7,090,264 B2 * 8/2006 Dzurko ..... E05B 85/243 292/201
7,789,440 B2 * 9/2010 Graute ..... E05B 85/26 292/216
8,348,309 B2 * 1/2013 Patel ..... E05B 77/38 292/195
9,347,246 B2 * 5/2016 Orzech ..... E05B 77/04
2001/0020790 A1 * 9/2001 Fisher ..... E05B 85/26 292/216
2005/0077734 A1 * 4/2005 Lim ..... E05B 83/26 292/216
2005/0212303 A1 * 9/2005 Brose ..... E05B 85/26 292/216
2006/0006669 A1 * 1/2006 Nelsen ..... E05B 17/0037 292/216
2006/0170224 A1 * 8/2006 Mitchell ..... E05B 77/04 292/216
2015/0159406 A1 * 6/2015 Hunt ..... E05B 79/10 292/216

OTHER PUBLICATIONS

Machine translation of DE102010009141A1 by Lexis Nexis Total Patent on Jul. 9, 2015.
Machine Translation of EP1500762A2 by Lexis Nexis Total Patent on Jul. 9, 2015.

* cited by examiner

METHOD FOR PRODUCING MOTOR VEHICLE DOOR LOCKS WITH PAWL PLACED IN AN OBLIQUE MANNER

CROSS-REFERENCE TO RELATED APPLICATIONS

This application is the U.S. national stage application of International Patent Application No. PCT/DE2013/000773, filed Dec. 11, 2013, which claims priority of German Application No. 10 2012 024 285.9, filed Dec. 12, 2012, which are both hereby incorporated by reference.

BACKGROUND

The invention relates to a method for producing motor vehicle door latches with the locking mechanism parts catch and pawl, in which the catch and pawl are stamped to provide vertical or near vertical edges with corresponding latch surfaces on catch and pawl and are then covered by a coating with the exception of the latch surfaces. The invention also relates to a motor vehicle door latch with a catch and a pawl retaining the catch in its closed state in which the catch and pawl contain corresponding latch surfaces on the vertical edges, created during stamping, as well as a coating that is, however, not applied to the latch surfaces.

It is known that creaking noises generated during driving of the motor vehicle and which can occur between the hanger arm and catch, can be reduced by either the hanger arm or also the catch being provided with a surface structure in the contact area, contributing to reducing the gliding friction. In the prior art disclosed in DE 10 2010 009 141 A1, grooves or respective webs are applied to the hanger arm in the contact area that run obliquely to the longitudinal axis of the hanger arm. These aim to reduce said creaking. These different solutions disclosed in DE 10 2010 009 141 A1 do, however, not take into consideration that during the actual production of the hanger arm and, in particular, of the locking parts catch and pawl, a surface favoring creaking exists on the corresponding latch surfaces. During stamping, channels and grooves are created on the edge surfaces which can engage with each other, in particular, when the pawl is pivoted away, causing said noises.

SUMMARY

The present invention has the task of providing a production method and a motor vehicle door latch in such a way that during movement of the catch and of the pawl against each other, a stick/slip effect is hardly negligible or does not occur at all.

The invention solves this task by the catch with its straight stamping contour being arranged on the base of the lock case housing with the catch surface being arranged parallel to the base, whilst the pawl is twisted by an angle and is connected to the base of the lock case housing.

As part of such a production method, the pawl can be installed in a way that the channels or grooves produced on the edge surfaces of the catch and pawl cannot engage when the pawl is pivoted away. Instead, the components, i.e. the catch and pawl glide along each other at a reduced gliding friction, resulting in the generated noises being considerably reduced or not being generated at all. The two latch surfaces rubbing against each other are now no longer in full contact but only make contact at the points at which the straight grooves on the catch and the oblique groves on the pawl are in contact with each other, i.e. where they overlap. The invention thus has a double effect, i.e. that the straight grooves on both components generated during production can no longer engage due to the oblique position of the catch and also that the sliding friction is reduced as the two grooves only permit contact at certain points.

An expedient further development of the invention provides for the pawl to be pivotably mounted on the base of the lock case housing, offset by an angle of 5-8°, with such an angle applying to a pawl having a thickness of approx. 4 mm and a gap to the stamping contour of the catch and pawl containing grooves of 0.15-0.30 mm. In case of a greater distance and/or another gap the calculated angle would be different but would, in any case fall into a range of between 5-15°. Advantageous is the fact that such an angle can be easily achieved by the solution offered by the invention, i.e. by the oblique arrangement of the pawl.

In order to provide the offset arrangement of the pawl without too much effort, the invention provides for the base of the lock case housing to contain a seat for the pawl, obliquely formed on the base. It is advantageous that the same fixing means can be used, so that only a small change has to be made as regards the lock case housing, that is to say to be able to arrange the pawl on the base by an offset angle.

In another option of providing the intended pawl arrangement, the seat of the pawl is connected to the base of the lock case housing using the conventional fixing of the pawl by means of a seat containing an oblique contact area. This means that during production of the lock case housing a respective deformation is simultaneously carried out, in order to achieve the desired seat for the pawl, i.e. the oblique seat is for instance pushed out of the base.

In another option of arranging the pawl as desired in an oblique manner in the lock case housing, the pawl is obliquely surrounded by a plastic coating, arranged flatly on the base of the lock case housing and which is connected to it. The plastic is anyway required for the coating and is in this case, in order to achieve the oblique arrangement of the pawl, simply applied as a specific coating, i.e. a coating making the oblique arrangement of the pawl within the lock case housing possible.

This oblique arrangement in the coating is particularly advantageous and is easily achieved if the coating is a rectangular plastic body in which the pawl is held offset by an angle required for the oblique arrangement of the stamped contour on the latch surface, in relation to the straight stamping contour of the latching surface of the catch. Such a specific oblique arrangement of the pawl also offers advantages for the installation, as the flat surface of the coating can be easily arranged and fixed on the lock case housing with the desired angle being provided at all times, as it is specified by the arrangement of the pawl in the coating.

In a further advantageous embodiment, the seat of the catch or the seats of the pawl and catch are connected to the base of the lock case housing in such a way that they are offset from each other. In this arrangement, the pawl rather than the catch are obliquely arranged in the lock case housing in such a way that the same effect as in the above solution is achieved. It is, however, possible to arrange the pawl and catch offset inside the lock case housing with the offset arrangement allowing the angle of obliqueness of the two locking mechanism parts to be respectively smaller.

The arrangement solves the task by the catch being arranged on the base of the lock case housing with the latch surface extending parallel to the base and the pawl being rotated by a specified angle, preventing the engagement of the stamping contours of both locking mechanism parts and being connected to the base of the lock case housing. As a result of the oblique arrangement or offset connection of the pawl on the base of the lock case housing, the channels and grooves on the latch surfaces of both locking mechanism parts can no longer engage with each other or more or less mesh, already preventing any unwanted noises. In addition, the oblique arrangement of the pawl ensures that the locking mechanism parts, i.e. the catch and the pawl make contact at certain points, as the two locking mechanism parts can only make contact in the area in which the straight and oblique channels and grooves overlap. As a result of this advantageous double effect, the wear of the motor vehicle door latch is also minimized, as the two locking mechanism parts only make contact at certain contact points on the latch surfaces.

Advantageously, the pawl is arranged on the base of the lock case housing offset by 5-8°. Such a small angle suffices in order to achieve an overlap at two points of each groove which is advantageous for the smooth operation of the motor vehicle door latch. It is furthermore advantageous that such a small angle can be easily provided without having to make major changes to the entire design of a motor vehicle door latch.

In an advantageous embodiment, the pawl with its seat connecting to the base is thus formed on the base or contains an oblique contact surface for the pawl and a usual connection to the pawl. This also shows that only small changes are required for implementing the invention that do not impede the work cycle, i.e. impede assembly, but only require a certain change to the moulds, with also the option of the seat being formed at the same time as the base of the lock case housing, for this purpose.

In another option of achieving the oblique or offset arrangement of the pawl on the base and attaining an always even effect, the pawl is fixed offset by the specified angle in the box-shaped coating forming a level base. The slope or offset arrangement of the pawl is thus always specified and the connection to the base of the lock case housing can remain unchanged, and it should be pointed out that the plastic coating is anyway always necessary and that thus only a small reorganization is required.

Instead of the oblique position of the pawl, also the option of connecting the seat of the catch or the seat of the catch and pawl to the base of the lock case housing in an oblique manner is disclosed. For the catch the same fixing as used for an oblique arrangement of the pawl must be used, whilst in case of an oblique arrangement of the catch and pawl, a respective smaller but opposing angle is used. As explained, this is easily achievable, in particular, due to the fact that the seat of the catch or seat of the pawl are either fixed or formed obliquely.

A particular advantage of the invention is the fact that with only minimal additional production effort, a motor vehicle door latch can be produced, in which the pawl and catch in the latching area, i.e. the area in which they both rest on top or against each other, are designed in such a way that prior art noise levels are considerably reduced. Also, an even movement of the pawl along the catch is ensured as the special arrangement of the pawl or also of the catch has the result that the existing grooves cooperate in such a way that only certain points of overlap or contact exist. In particular, the respective grooves produced during stamping can no longer engage with each other, causing unwanted noises. Various options for the respective oblique or offset arrangement of the pawl or of the other locking mechanism parts are available. The coating can, for example, also be arranged in such a way that it defines the oblique position of the pawl, whilst the flat base of the box-shaped coating part ensures a light connection with the base of the lock case housing.

Further details and advantages of the object of the invention are disclosed in the below description of the respective drawing, showing a preferred embodiment with the required details and components. In which:

DETAILED DESCRIPTION OF THE DRAWINGS

Figure 1:
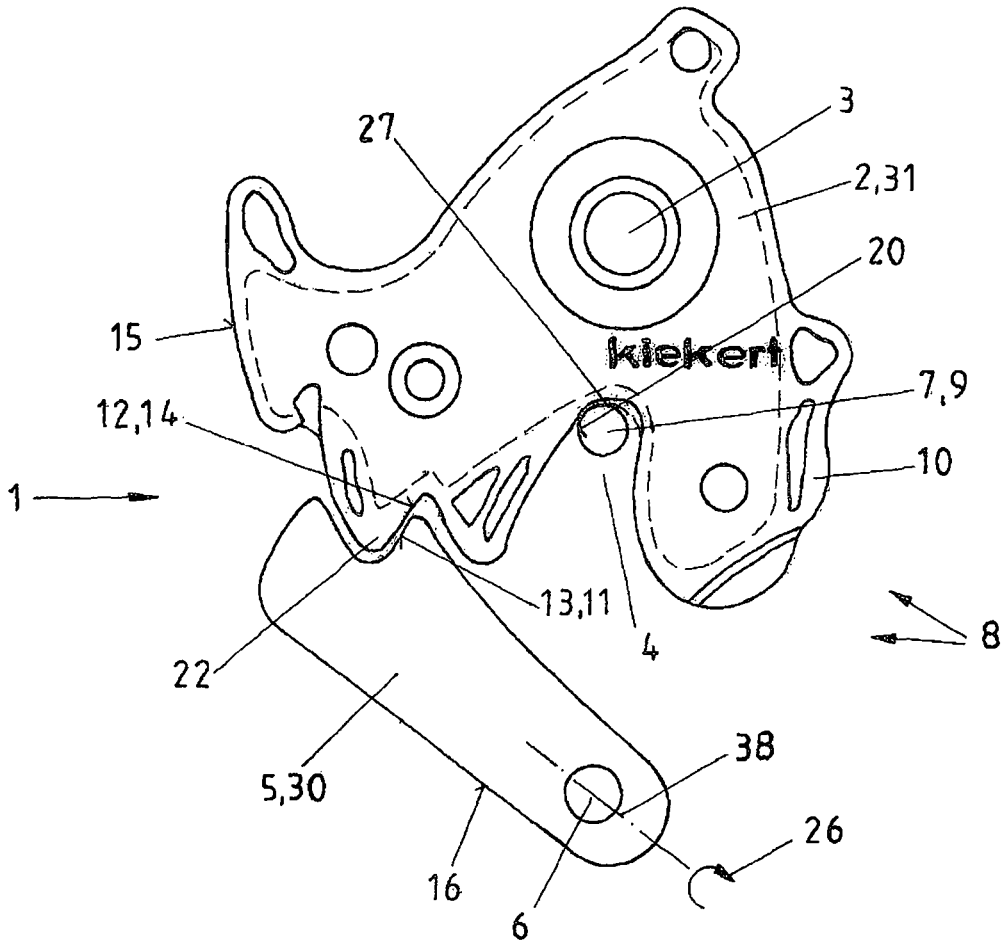
FIG. 1 shows a top view of a motor vehicle door latch in its closed state.

FIG. 1 shows a top view of a motor vehicle door latch 1, in which the catch 2 moving around axis 3 contains the hanger arm 9 of the lock bracket 7.

Figure 3:
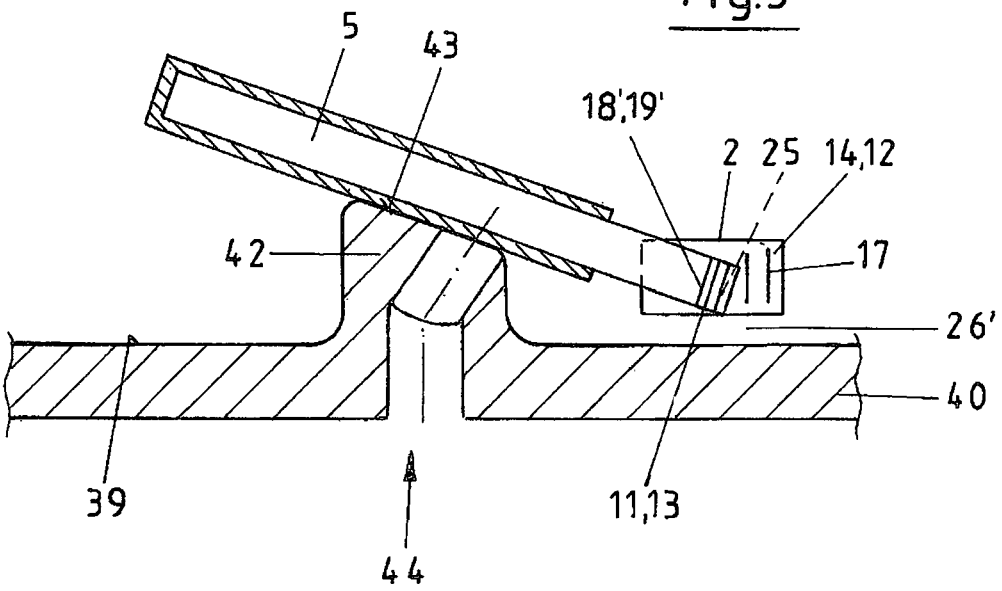
FIG. 3 shows another option of connecting the obliquely arranged pawl to the base.

The figure thus shows the closed state of a motor vehicle door latch 1, in which the catch 2 is retained by pawl 5 pivotable along pawl axis 6, i.e. the motor vehicle door latch 1 can only be opened again once the pawl 5 has been pivoted away which is achieved by means of the motor vehicle door handle, not shown in the figure. By means of the seat 4, the hanger arm 9 is moved into the lowest point 27 of the catch 2, thus securing the closed state, also of the motor vehicle door—not shown—with the locking mechanism parts 30, 31, i.e. the pawl 5 and the catch 2 being parts of the motor vehicle door, whilst the lock bracket 7 and the hanger arm 9 are fixed to the car body of the motor vehicle. The locking mechanism parts 30, 31 of the locking mechanism 8 are produced from respective sheet metal using a, preferable, multiple stamping operation, in which on the latch surfaces 12, 13 not covered by coating 10, the surface of both locking mechanism parts 30, 31 is characterized by a stamped contour 14. In the area of the latch surface 13, this surface arrangement has, however, been changed by the offset or slightly turned arrangement of the component, in particular the pawl 5, whose grooves 18, 19, forming the stamped contour 11, are arranged in an oblique manner, which in FIG. 3 are respectively shown as obliquely arranged grooves 18', 19'. This stamping contour 11, 13 produces a considerably improved sliding friction between the locking mechanism parts 30, 31, i.e. the pawl 5 and the catch 2, so that unwanted noises are no longer generated. Not particularly apparent from the figure is the fact that the edges 15, 16 of the catch 2 and the pawl 5 are covered by a plastic coating 10. The edges 15, 16 are thus covered by such a coating with the exception of the area of the latch surfaces 12, 13 and of the contact surface 20 where no coating 10 is applied, allowing the special surface structure shown in the below figures, to become effective. The surface structure reduces noise and sliding friction to a minimum, with both being related.

Figure 2:
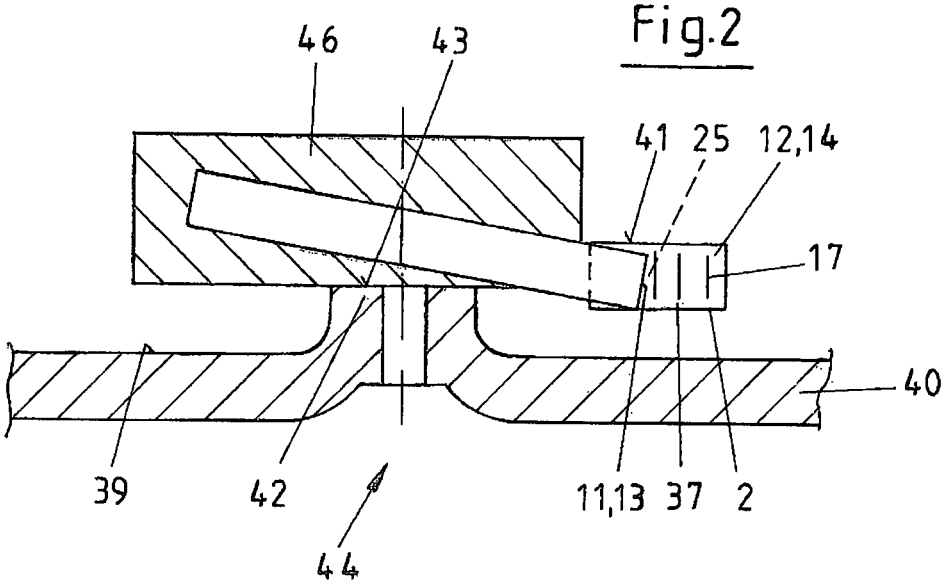
FIG. 2 shows an enlarged view of the connection between the catch and the base of the lock case housing.

FIG. 2 shows the area of the latch surface 12 on the catch 2 that must correspond with the latch surface 13 on the pawl 5 during opening and closing of the motor vehicle door latch 1. This means that during opening and closing of the motor vehicle door latch, both locking mechanism parts 30, 31 rub against each other or, as regards their edges 15, 16, even on top of each other in the area of their latch surfaces 12, 13, which as shown in particular in FIG. 2, can cause problems in case of a catch 2 having straight grooves 17, when the latch surface 13 on the pawl 5 has the same design, i.e. also contains grooves that remain straight. This is, however, not the case, as the entire pawl 5 is connected to the base 39 of a lock case housing 40 offset by an angle. In order to achieve this, the base 39 contains a seat 42, slightly protruding over the base 39 or that is achieved by a respective deformation. The support surface 43 arranged parallel to the base 39 supports a box 46 representing the coating 10 in this case, in which the entire pawl 5 is respectively sloped or obliquely arranged. As a result, the grooves 18, 19 on the pawl 5 are arranged obliquely in the area of the latch surfaces 12, 13 as shown with reference numerals 18', 19'. The aforementioned adverse noises and excessive friction can thus no longer occur. The seat 42 contains a hole, allowing the usual connection 44 between base 39 and pawl 5 to be provided.

In place of the box 46 in which the pawl 5 is arranged in an oblique manner, FIG. 3 shows an oblique arrangement of the support surface 43 of the seat 42 so that the pawl 5 is in an oblique position, when the connection 44 is produced. The figure also shows that the latch surfaces 12, 13 with the straight stamping contour 14 and the oblique or obliquely arranged stamping contour 11 reliably prevents an engagement of the grooves 17, 18, 19. Both FIG. 2 and FIG. 3 show that this other locking mechanism part 31, i.e. the catch surface 41 of the catch 2 is arranged parallel to the surface of the base 39. Although not shown in the drawings, it is possible for both the pawl 5 and the catch 2 to be arranged at an angle in order to reliably prevent engagement of the straight grooves 17 and oblique grooves 18, 19, with the angles being offset to one another.

Figure 4:
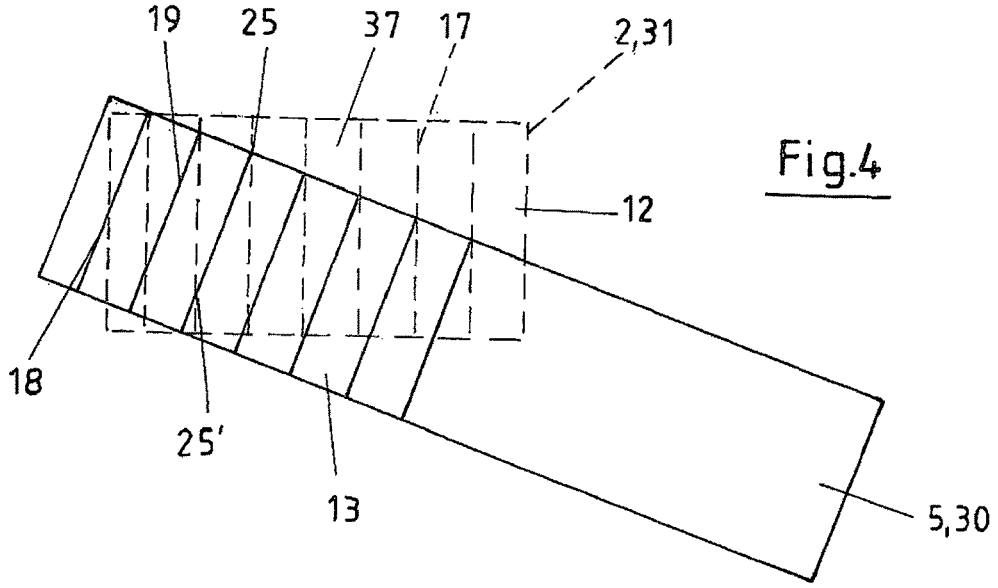
FIG. 4 shows a schematic view of the facing latch surfaces of the catch and pawl and FIG. 5 shows a perspective view of the catch with the special edge formation.

To clarify this situation, FIG. 4 shows again how the latch surfaces 12, 13 of the catch 2 and pawl 5 rest on each other during operation of the motor vehicle door latch 1. For reasons of clarification, a respective larger angle than is actually required is shown. Numeral 25 refers to the overlapping points 25, 25' with area 37 of the catch 2, facing the pawl 5, being shown as a dashed line, in order to point out that the stamping contour is not straight.

FIG. 1 indicates the longitudinal axis 38 of the pawl 5 and also reference numeral 26'. This pawl 5 is respectively pivoted around said longitudinal axis and connected to the base 39 of the lock case housing 40.

Figure 5:
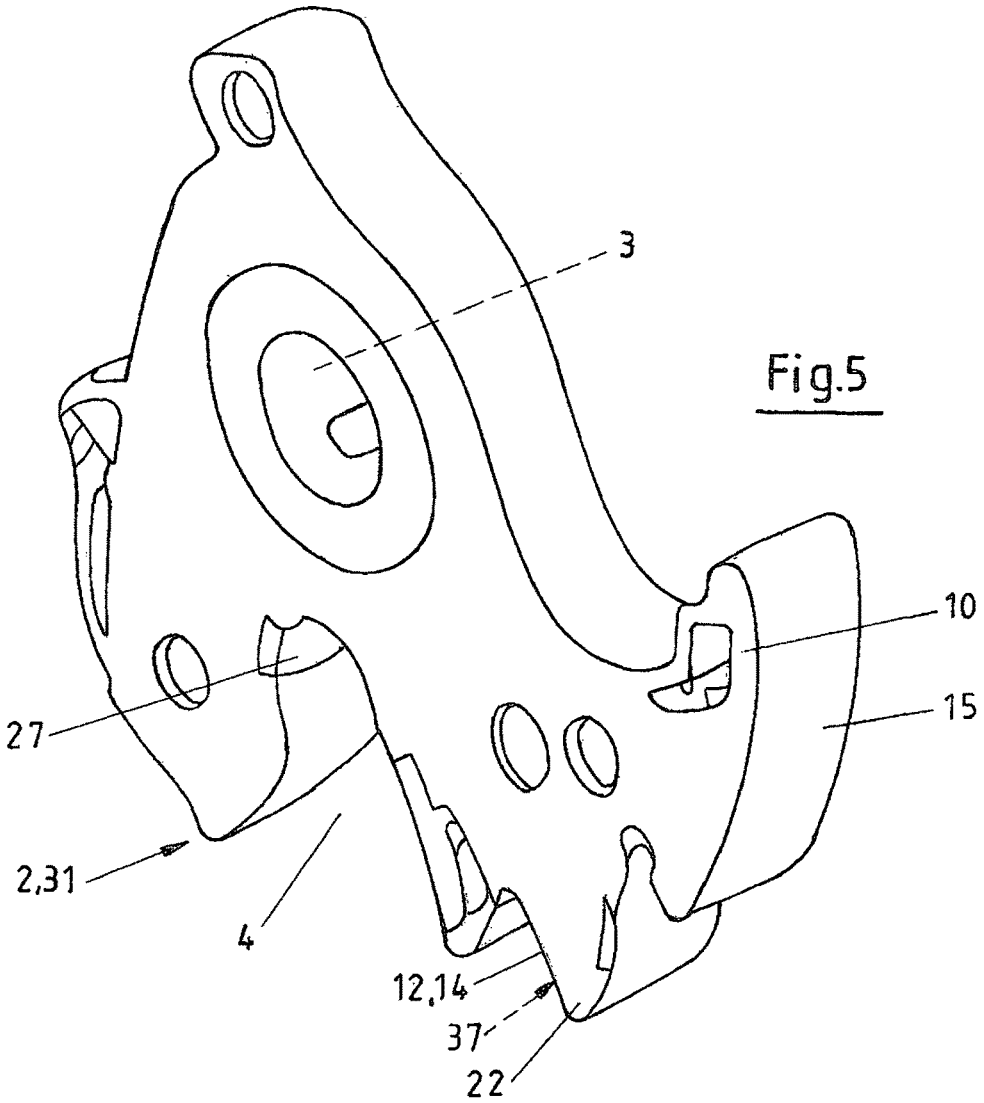

FIG. 5 shows a perspective view of the catch 2, pivotable around axis 3, not shown in the figure. When pivoting the catch 2, the hanger arm 9—not shown in FIG. 5—is inserted in the seat 4 and subsequently released again, so that the motor vehicle door can then be opened or closes evenly. In the locked position, the catch 2 is retained by the pawl 5. FIG. 5 shows that the stamping of the catch 2 produces a clearly visible edge 15, whose surface, as explained above, is characterized by the stamped contour 14 on the latch surface 12. This stamped contour 14 is only indicated in FIG. 5. The latch surface 12 indicates the main ratchet position 22, i.e. the position in which the pawl 5 prevents the catch 2 from pivoting back when in the closed position. As already mentioned above, the latch surface 13 of the pawl then rests on the latch surface 12 of the catch 2 and both can slide past each other with less friction and without any unwanted noise being generated, as the straight grooves 17 of the catch 2 and the oblique grooves 18', 19' of the pawl 5 cannot engage or interlock.

At the lowest point 27 of the seat 4 it is apparent that it contains a surface differing from the surface of the edge 15, which is in particular achieved by the fact that it does not contain any coating 10. The figure shows that a separate part has also been inserted at this point in order to improve the sliding effect of the catch 2 on the hanger arm 9.

All aforementioned characteristics, including those only shown in the drawings, are separately or in combination essential parts of the invention.

The invention claimed is:

1. Method for producing motor vehicle door locks with the locking mechanism parts catch and pawl, the method comprising:

stamping the catch and pawl resulting in straight contours and vertical or near vertical edges with corresponding latch surfaces on the catch and pawl, attaching the catch with its straight stamped contour to a first seat on a base of a lock case housing and arranging the latching surfaces of the catch perpendicular to the base, attaching the pawl to a second seat on the base such that the pawl is arranged in a specified angle with respect to a plane of the base surrounding the second seat so that the latching surface of the pawl is not parallel to or is oblique to the latching surface of the catch in order to prevent meshing of the stamped contours of both lock mechanism parts and wherein, after attaching the pawl to the second seat, the pawl is obliquely angled relative to the plane by the specified angle.

2. Method according to claim 1, wherein the pawl is offset by an angle of 5-8° relative to the plane and is pivotably fixed to the base in which this angle applies for a pawl of approx. 4 mm thickness and a distance of the grooves of 0.15-0.30 mm constituting the stamped contour of the catch and pawl.

3. Method according to claim 1, wherein the base contains a seat for the pawl arranged in an oblique manner on the plane.

4. Method according to claim 3, wherein, using a conventional connection of the pawl, the seat is connected to the base by means of a seat containing an oblique support surface.

5. Method according to claim 4, wherein the pawl is obliquely retained by a plastic coating, lying flat on the base and is connected to the housing.

6. Method according to claim 5, wherein the coating is a rectangular plastic body, in which the pawl is retained whilst being offset by an angle required for obtaining an oblique stamped contour on the pawl latch surface in relation to the straight stamped contour of the catch latch surface.

7. Method according to claim 1, wherein the pawl is obliquely retained by a plastic coating, lying flat on the base and is connected to the housing.

8. Method according to claim 7, wherein the coating is a rectangular plastic body, in which the pawl is retained whilst being offset by an angle required for obtaining an oblique stamped contour on the pawl latch surface in relation to the straight stamped contour of the catch latch surface.

9. Method according to claim 1, further comprising, after stamping of the catch and pawl, covering the catch and pawl with a coating except for the latch surfaces.

10. Method according to claim 1, wherein the base surrounding the first seat is on the plane.

11. Method according to claim 1, wherein the latch surfaces of the catch and pawl rub against each other only at points in which the straight grooves on the catch and the straight grooves on the pawl are obliquely aligned relative to each other.

12. Motor vehicle door lock containing a catch and a pawl retaining the catch in a closed state, wherein the catch and pawl contain corresponding latch surfaces on their vertical edges that include straight contours, produced during stamping, wherein the catch is arranged on a first seat on a base of a lock case housing and the latching surface of the catch is perpendicular to the base; wherein the pawl is connected to a second seat on the base and the pawl is arranged in a specified angle with respect to a plane of the base surrounding the second seat such that the latch surface of the pawl is not parallel to or is oblique to the latch surface of the catch in order to prevent meshing of stamped contours of both locking mechanism parts, wherein the pawl is obliquely angled relative to the plane by the specified angle.

13. Motor vehicle door lock according to claim 12, wherein the pawl is angled relative to the plane by 5-8° and is arranged on the base.

14. Motor vehicle door lock according to claim 13, wherein the pawl is fixed in a box-shaped coating, forming a flat base and being offset by the specified angle.

15. Motor vehicle door lock according to claim 12, wherein by means of a seat, providing a connection to the base, the pawl is formed obliquely on the base or that the arrangement contains an oblique support surface for the pawl and a usual connection.

16. Motor vehicle door lock according to claim 15, wherein the pawl is fixed in a box-shaped coating, forming a flat base and being offset by the specified angle.

17. Motor vehicle door according to claim 12, wherein the pawl is fixed in a box-shaped coating, forming a flat base and being offset by the specified angle.

18. Motor vehicle door lock according to claim 12, wherein the catch and pawl further comprise a coating except on the latch surfaces.

19. Motor vehicle door lock according to claim 12, wherein the base surrounding the first seat is on the plane.

20. Motor vehicle door lock according to claim 12, wherein the latch surfaces of the catch and pawl rub against each other only at points in which the straight grooves on the catch and the straight grooves on the pawl are obliquely aligned relative to each other.

* * * * *